US011018457B2

(12) United States Patent
Pickel et al.

(10) Patent No.: US 11,018,457 B2
(45) **Date of Patent: *May 25, 2021**

(54) ELECTRICAL CONNECTOR WITH INSERTION LOSS CONTROL WINDOW IN A CONTACT MODULE

(71) Applicant: TE Connectivity Services GmbH, Schaffhausen (CH)

(72) Inventors: Justin Dennis Pickel, Hummelstown, PA (US); Arturo Pachon Munoz, San Jose, CA (US); Timothy Robert Minnick, Enola, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/507,213

(22) Filed: Jul. 10, 2019

(65) Prior Publication Data

US 2019/0334291 A1 Oct. 31, 2019

Related U.S. Application Data

(63) Continuation-in-part of application No. 15/936,631, filed on Mar. 27, 2018, now Pat. No. 10,355,416.

(51) Int. Cl.

| | |
|---|---|
| ***H01R 13/6587*** | (2011.01) |
| ***H01R 13/514*** | (2006.01) |
| ***H01R 13/646*** | (2011.01) |
| ***H01R 13/518*** | (2006.01) |

(52) U.S. Cl.
CPC ..... *H01R 13/6587* (2013.01); *H01R 13/514* (2013.01); *H01R 13/518* (2013.01); *H01R 13/646* (2013.01)

(58) Field of Classification Search
None
See application file for complete search history.

(56) References Cited

U.S. PATENT DOCUMENTS

| | | | |
|---|---|---|---|
| 7,771,233 | B2 | 8/2010 | Gailus |
| 7,794,278 | B2 | 9/2010 | Cohen et al. |
| 8,262,412 | B1 | 9/2012 | Minnick et al. |
| 8,366,485 | B2 | 2/2013 | Johnescu et al. |
| 8,398,431 | B1 | 3/2013 | Whiteman, Jr. et al. |
| 8,771,016 | B2 | 7/2014 | Atkinson et al. |
| 8,998,642 | B2 | 4/2015 | Manter et al. |
| 9,219,335 | B2 * | 12/2015 | Atkinson ..... H01R 13/6471 |

(Continued)

*Primary Examiner* — Jean F Duverne

(57) ABSTRACT

An electrical connector includes a contact module having a first dielectric frame holding first conductors and a second dielectric frame holding second conductors stacked with the first dielectric frame to form the contact module. The first dielectric frame has insertion loss control windows defining air pockets exposing exposed portions of the corresponding first conductors to air. The size and shape of the insertion loss control windows control insertion loss along the first conductors. The second dielectric frame has insertion loss control windows defining air pockets exposing exposed portions of the corresponding second conductors to air. The size and shape of the insertion loss control windows control insertion loss along the second conductors. The insertion loss control windows of the second dielectric frame are aligned with and are open to the insertion loss control windows of the first dielectric frame.

11 Claims, 7 Drawing Sheets

(56) References Cited

U.S. PATENT DOCUMENTS

| | | | | |
|---|---|---|---|---|
| 9,583,895 | B2 * | 2/2017 | Buck | H01R 13/719 |
| 9,666,998 | B1 | 5/2017 | de Boer et al. | |
| 9,917,406 | B1 | 3/2018 | Iwasaki et al. | |
| 10,186,811 | B1 | 1/2019 | Trout et al. | |
| 10,355,416 | B1 * | 7/2019 | Pickel | H01R 13/405 |
| 2012/0184140 | A1 * | 7/2012 | Davis | H01R 12/727<br>439/607.34 |
| 2015/0200508 | A1 * | 7/2015 | Martin | H01R 13/42<br>439/695 |
| 2019/0020155 | A1 | 1/2019 | Trout et al. | |

* cited by examiner

ELECTRICAL CONNECTOR WITH INSERTION LOSS CONTROL WINDOW IN A CONTACT MODULE

CROSS-REFERENCE TO RELATED APPLICATIONS

This application is a continuation-in-part application of, and claims benefit to the filing date of, U.S. patent application Ser. No. 15/936,631, filed Mar. 27, 2018, titled, ELECTRICAL CONNECTOR WITH INSERTION LOSS CONTROL WINDOW IN A CONTACT MODULE, the subject matter of which is herein incorporated by reference in its entirety.

BACKGROUND OF THE INVENTION

The subject matter herein relates generally to an electrical connector configured to transmit electrical signals with low insertion loss.

Electrical connectors include terminals or conductors that provide conductive current paths through the connectors for interconnecting cables, circuit boards, or the like. Some known electrical connectors include contact modules that have a plurality of conductors, which may be arranged in pairs, held in a dielectric frame. As electrical connectors are made smaller, the conductors are susceptible to signal degradation, such as from insertion loss A need remains for a high-speed electrical connector with low insertion loss conductors.

BRIEF DESCRIPTION OF THE INVENTION

In one embodiment, an electrical connector is provided. The electrical connector includes a contact module having a first dielectric frame holding first conductors and a second dielectric frame holding second conductors stacked with the first dielectric frame to form the contact module. The first conductors extend between a mating end and a terminating end. The first conductors have a transition portion between the corresponding mating end and the terminating end passing through the first dielectric frame. The transition portions of the first conductors have opposite first and second sides and opposite first and second edges between the first and second sides. The second conductors extend between a mating end and a terminating end. The second conductors have a transition portion between the corresponding mating end and the terminating end passing through the second dielectric frame. The transition portions of the second conductors have opposite first and second sides and opposite first and second edges between the first and second sides, wherein the first and second conductors are arranged in pairs. The first dielectric frame has insertion loss control windows defining air pockets exposing exposed portions of the corresponding first conductors to air. The size and shape of the insertion loss control windows control insertion loss along the first conductors. The second dielectric frame has insertion loss control windows defining air pockets exposing exposed portions of the corresponding second conductors to air. The size and shape of the insertion loss control windows control insertion loss along the second conductors. The insertion loss control windows of the second dielectric frame are aligned with and are open to the insertion loss control windows of the first dielectric frame.

In another embodiment, a contact module for an electrical connector is provided. The contact module includes a first dielectric frame holding first conductors. The first conductors each extend between a mating end and a terminating end. The first conductors each have a transition portion between the corresponding mating end and the terminating end passing through the first dielectric frame. The transition portions of the first conductors have opposite first and second sides and opposite first and second edges between the first and second sides. The first dielectric frame has first insertion loss control windows defining air pockets exposing exposed portions of the corresponding first conductors to air. The size and shape of the first insertion loss control windows control insertion loss along the first conductors. A second dielectric frame holds second conductors. The second dielectric frame is stacked with and coupled to the first dielectric frame to form the contact module. The second conductors each extend between a mating end and a terminating end. The second conductors each have a transition portion between the corresponding mating end and the terminating end passing through the second dielectric frame. The transition portions of the second conductors have opposite first and second sides and opposite first and second edges between the first and second sides. The first and second conductors are arranged in pairs. The second dielectric frame has second insertion loss control windows defining air pockets exposing exposed portions of the corresponding second conductors to air. The size and shape of the second insertion loss control windows control insertion loss along the second conductors. The first and second insertion loss control windows are arranged in pairs aligned with and open to each other to form common air pocket for the pairs of first and second conductors.

DETAILED DESCRIPTION OF THE INVENTION

Figure 1:
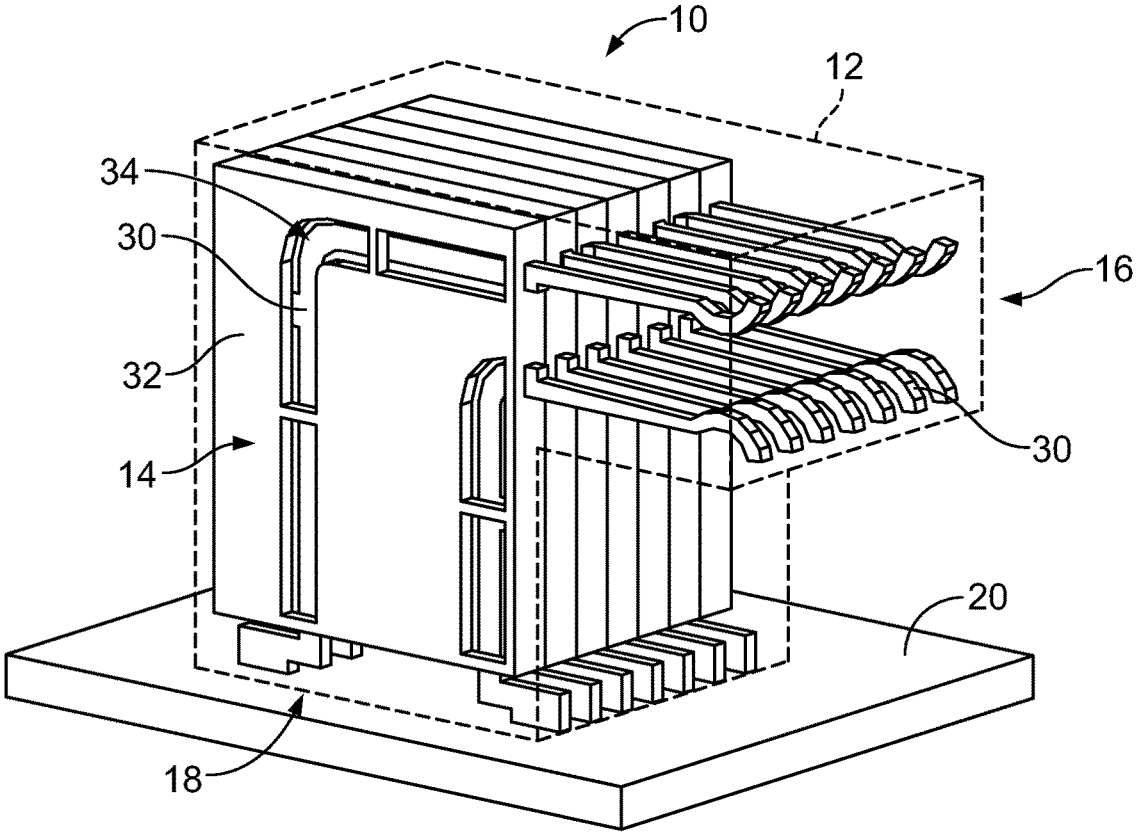
FIG. 1 illustrates an electrical connector in accordance with an exemplary embodiment.

FIG. 1 illustrates an electrical connector 10 in accordance with an exemplary embodiment. The electrical connector 10 includes a housing 12 holding a plurality of contact modules 14 in a stacked configuration. The contact modules 14 are held in the housing 12. The electrical connector 10 extends between a mating end 16 and a terminating end 18. In an exemplary embodiment, the electrical connector 10 is configured to be mounted to a circuit board 20 at the terminating end 18. Alternatively, the electrical connector 10 may be a cable electrical connector having a plurality of cables at the terminating end 18.

In the illustrated embodiment, the electrical connector 10 is a right angle connector having the mating end 16 and the terminating end 18 oriented perpendicular to each other. Other orientations are possible in alternative embodiments. In the illustrated embodiment, the mating end 16 defines a card edge slot configured to receive a card edge of a circuit card; however, other types of electrical connectors 10 may be provided in alternative embodiments.

The contact modules 14 each include a plurality of conductors 30 extending between the mating end 16 and the terminating end 18. The conductors 30 are configured to be electrically connected to the circuit board 20. The conductors 30 are configured to be electrically connected to a mating electrical connector at the mating end 16.

The contact modules 14 each include a dielectric frame 32 holding the conductors 30. In various embodiments, the conductors 30 may be formed from a leadframe and the dielectric frame 32 may be overmolded over the conductors 30 of the leadframe. Other types of contact modules may be provided in alternative embodiments. For example, the dielectric frame 32 may be pre-formed and the conductors 30 may be loaded into the dielectric frame 32 in alternative embodiments.

In an exemplary embodiment, the dielectric frame 32 is designed to improve insertion loss through the contact module 14. For example, in an exemplary embodiment, the dielectric frame 32 includes openings or windows 34 exposing the conductors 30 to air to improve insertion loss of the conductors 30 through the contact module 14. The size, shape, and location of the windows 34 are designed to control insertion loss. The dielectric frame 32 may be designed to improve other aspects of signal integrity through the contact module 14, such as to improve skew control, crosstalk or other characteristics.

Figure 2:
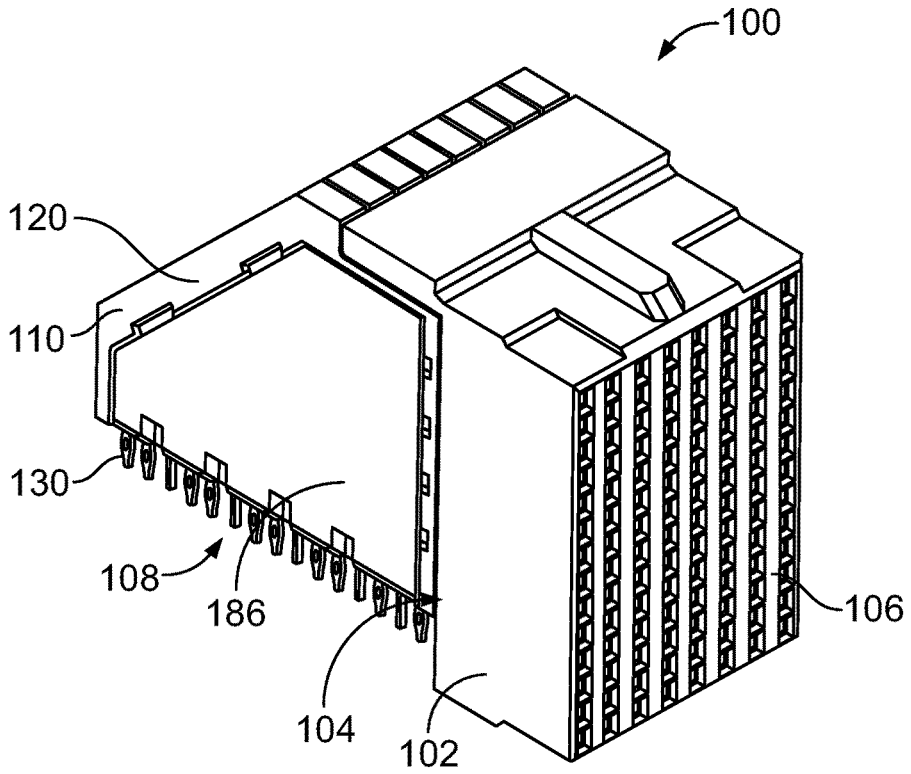
FIG. 2 is a perspective view of an electrical connector formed in accordance with an exemplary embodiment.
Figure 3:
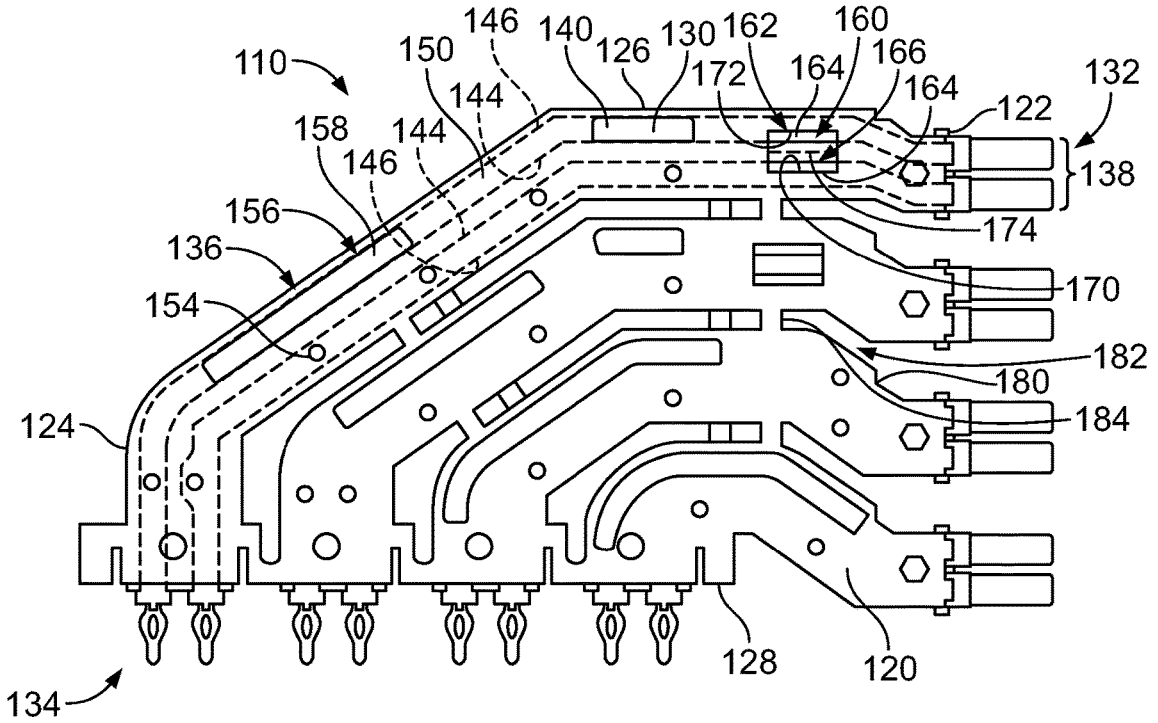
FIG. 3 illustrates a first side of a contact module of the electrical connector in accordance with an exemplary embodiment.
Figure 4:
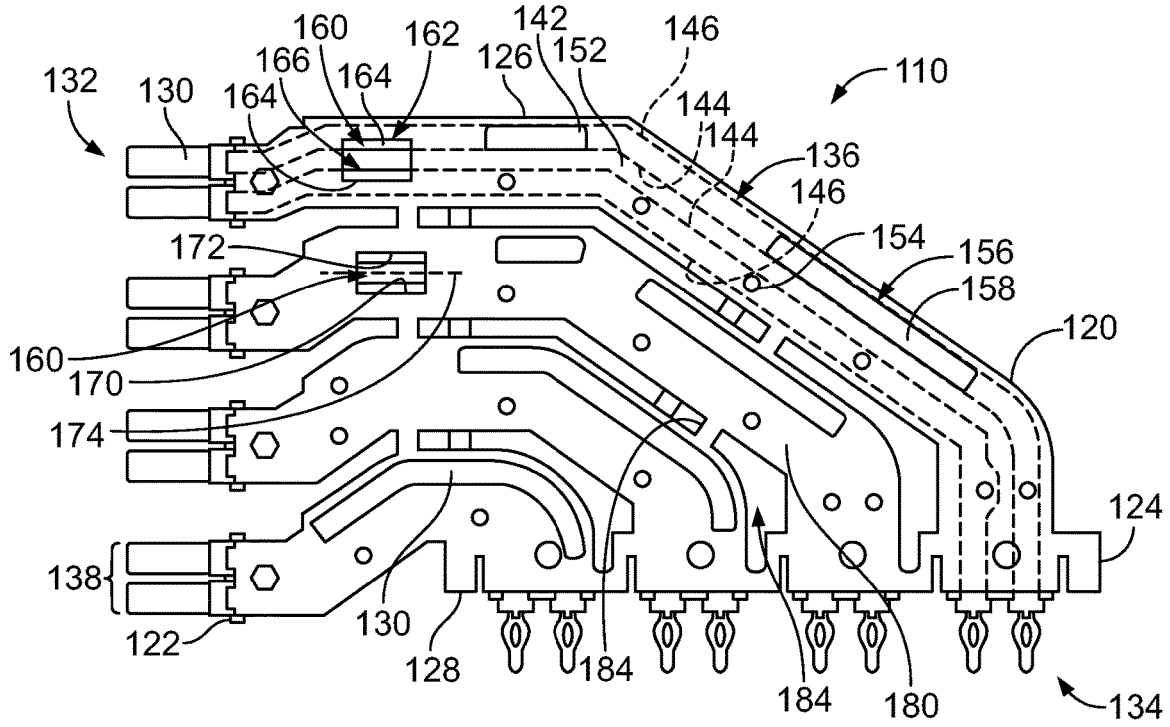
FIG. 4 illustrates a second side of the contact module.
Figure 5:
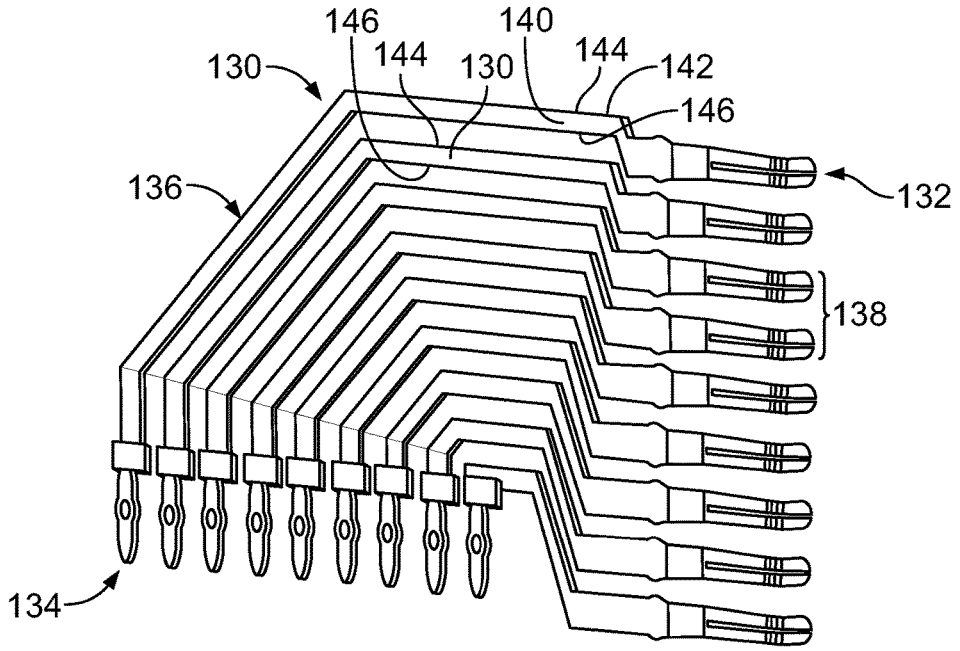
FIG. 5 illustrates a portion of the contact module showing conductors of the contact module in accordance with an exemplary embodiment.

FIG. 2 is a perspective view of an electrical connector 100 formed in accordance with an exemplary embodiment. FIG. 3 illustrates a first side of conductors 130 of a contact module 110 of the electrical connector 100 in accordance with an exemplary embodiment. FIG. 4 illustrates a second side of the conductors 130 of the contact module 110. FIG. 5 illustrates a portion of the contact module 110 showing conductors 130 of the contact module 110 in accordance with an exemplary embodiment.

The electrical connector 100 includes a housing 102 (FIG. 2) holding a plurality of the contact modules 110 in a stacked configuration. In an exemplary embodiment, the housing 102 includes a cavity 104 that receives the contact modules 110. In the illustrated embodiment, the electrical connector 100 is a high-speed backplane receptacle connector, such as a Z-PACK TinMan receptacle connector commercially available from TE Connectivity Corporation, Berwyn, Pennsylvania.

The electrical connector 100 extends between a mating end 106 and a terminating end 108. In an exemplary embodiment, the electrical connector 100 is a right-angle connector having the mating end 106 perpendicular to the terminating end 108. Optionally, the electrical connector 100 may be configured to be mounted to a circuit board at the terminating end 108. Alternatively, the electrical connector 100 may be a cable electrical connector having a plurality of cables at the terminating end 108.

The contact modules 110 each include a plurality of conductors 130 extending between the mating end 106 and the terminating end 108. The conductors 130 are configured to be electrically connected to the circuit board (or the cables in the cable electrical connector). The conductors 130 are configured to be electrically connected to a mating electrical connector, such as a header connector, at the mating end 106.

The contact modules 110 each include a dielectric frame 120 (FIGS. 3 and 4) holding the conductors 130. In an exemplary embodiment, the dielectric frame 120 may be overmolded over the conductors 130 of the leadframe. Other types of contact modules may be provided in alternative embodiments. For example, the dielectric frame 120 may be pre-formed and the conductors 130 may be loaded into the dielectric frame 120 in alternative embodiments. In an exemplary embodiment, the dielectric frame 120 includes a front 122, a rear 124, a top 126 and a bottom 128. In the illustrated embodiment, the front 122 is configured to be loaded into the cavity 104 of the housing 102 at the mating end 106. In the illustrated embodiment, the bottom 128 defines the terminating end 108 of the electrical connector 100.

In an exemplary embodiment, the conductors 130 are formed from a leadframe. The conductors 130 are signal contacts extending between the mating end 106 and the terminating end 108 for electrically connecting the electrical connector 100 to the mating connector and the circuit board. Optionally, some of the conductors 130 may be ground contacts arranged between various signal contacts to provide electrical shielding for the signal contacts. Alternatively, as in the illustrated embodiment, all of the conductors 130 are signal contacts; however, the contact modules 110 may include shields for providing electrical shielding.

The conductors 130 each include a mating end 132, a terminating end 134 and a transition portion 136 (FIG. 5) extending between the mating end 132 and the terminating end 134. The transition portion 136 extends through the dielectric frame 120 and may be at least partially embedded in the dielectric frame 120.

In the illustrated embodiment, the mating end 132 extends forward from the front 122 of the dielectric frame 120 for mating connection with the mating connector. Optionally, the mating end 132 may form a socket contact or receptacle configured to be mated with a corresponding mating contact of the mating connector. For example, in the illustrated embodiment, the mating end 132 includes a pair of beams separated by a gap configured to receive a pin contact. Other types of contacts may be provided in alternative embodiments at the mating end 132, such as a pin contact, a spring beam, or another type of contact.

In the illustrated embodiment, the terminating end 134 extends downward from the bottom 128 for termination to the circuit board. Optionally, the terminating end 134 may be a compliant pin, such as an eye of the needle pin, configured to be loaded into a plated via of the circuit board. Other types of terminating contacts may be provided at the terminating end 134, such as solder contacts, spring beams, and the like.

In an exemplary embodiment, the conductors 130 are stamped and formed contacts stamped from a metal plate. Optionally, each of the conductors 130 may be stamped from the same plate is part of a leadframe. In an exemplary embodiment, the conductors 130 are arranged in pairs 138 configured to convey differential signals. However, in alternative embodiments, the conductors 130 may be single ended conductors rather than differential pairs.

The transition portions 136 transition between the mating ends 132 and the terminating ends 134. Optionally, the transition portions 136 may have a right angle transition between the mating ends 132 and the terminating ends 134 to define a right angle contact module 110. In an exemplary embodiment, each conductor 130 has a first side 140, a second side 142, an inner or first edge 144 and an outer or second edge 146. Optionally, the first and second edges 144, 146 may be the cut edges formed during the stamping process. For example, the first and second edges 144, 146 extend through the thickness of the metal plate used in the stamping process. Optionally, the first and second sides 140, 142 are wider than the first and second edges 144, 146.

The dielectric frame 120 holds the conductors 130. In an exemplary embodiment, the dielectric frame 120 is overmolded over the conductors 130. The dielectric frame 120 has opposite first and second sides 150, 152 extending between the front 122 and the rear 124 and extending between the top 126 and the bottom 128. The sides 150, 152 face other contact modules 110 in the contact module stack. In an exemplary embodiment, the first and second sides 150, 152 are generally parallel to the first and second sides 140, 142 of the conductors 130.

In an exemplary embodiment, the dielectric frame 120 includes a number of openings in the first side 150 (FIG. 3) and/or the second side 152 (FIG. 4) exposing the conductors 130. For example, in an exemplary embodiment, the dielectric frame 120 includes a plurality of pinch points 154 in the first and second sides 150, 152 that are formed during the manufacturing process. For example, the pinch points 154 are formed by components in the mold that are used to hold the conductors 130 during the molding process. When the mold is removed, the pinch points 154 remain in the dielectric frame 120. The pinch points 154 are small openings placed intermittently along the lengths of the conductors 130 used for manufacturing the contact module 110 for holding the conductors 130 during molding. Longer conductors 130 have more pinch points 154. In the illustrated embodiment, the pinch points 154 are circular; however, the pinch points 154 may have other shapes in alternative embodiments.

In the illustrated embodiment, the dielectric frame 120 includes a plurality of skew windows 156 in the first side 150 and/or the second side 152. The skew windows 156 expose sections of the transition portion 136 to air. The skew windows 156 define exposed portions 158 of the transition portions 136. The skew windows 156 are used to control skew along the conductors 130. The skew windows 156 enhance signal integrity and electrical performance of the conductors 130. In the illustrated embodiment, the skew windows 156 are only provided along the longer of the two conductors 130 within each pair 138. By exposing the longer conductors to air, the signals passing through the longer conductors may travel more quickly to reduce skew along the pair 138 of conductors 130 between the mating end 132 and the terminating end 134.

In an exemplary embodiment, the dielectric frame 120 includes insertion loss control windows 160 in the first side 150 and/or the second side 152. The insertion loss control windows 160 control insertion loss along the conductors 130. The insertion loss control windows 160 define air pockets 162 exposing exposed portions 164 of the transition portions 136 to air. Providing air around the exposed portions 164 of the transition portions 136 reduces insertion loss and enhances signal integrity of the conductors 130. The size and shape of the insertion loss control windows 160 control insertion losses along the conductors 130.

In an exemplary embodiment, the insertion loss control windows 160 bridge across the exposed portions 164 of the corresponding pairs 138 of conductors 130. For example, the insertion loss control windows 160 are aligned with gaps 166 between conductors 130 of the corresponding pair 138 of conductors 130. Each insertion loss control window 160 exposes two conductors 130. For example, the first edges 144 of each conductor 130 within the pair 138 of conductors 130 face each other across the gap 166. As such, the first edge 144 of the outer conductor 130 of the pair 138 is along the bottom edge and the first edge 144 of the inner conductor 130 of the pair 138 is along the top edge. The insertion loss control window 160 exposes both first edges 144 of the pair 138 in the same insertion loss control window 160. In an exemplary embodiment, the insertion loss control window 160 may be approximately centered above the corresponding gap 166. In an exemplary embodiment, the insertion loss control window 160 is provided on both the first side 150 and the second side 152.

Optionally, portions of the first sides 140 and/or the second sides 142 of both conductors 130 within the pair 138 are exposed within the insertion loss control window 160. Optionally, approximately half of the width of both conductors 130 within the pair 138 are exposed within the insertion loss control window 160. In such embodiments, the outer halves of both conductors 130 within the pair 138 are covered by the material of the dielectric frame 120. Alternatively, less than half of the width of each conductor 130 may be exposed within the insertion loss control window 160. In other alternative embodiments, more than half of the width of each conductor 130 is exposed within the insertion loss control window 160. In various embodiments, the entire width of the conductors 130 of each pair 138 are exposed within the insertion loss control window 160. For example, the insertion loss control window 160 may extend to both second edges 146 (for example the outer edges) of both conductors 130 of the pair 138.

In an exemplary embodiment, the insertion loss control window 160 extends between an inner edge 170 and an outer edge 172. The insertion loss control window 160 includes a center line 174 centered between the inner edge 170 and the outer edge 172. Optionally, the center line 174 may be aligned with the corresponding gap 166 between the first edges 144 of the pair 138 of conductors 130. Optionally, the inner edge 170 may be aligned with the exposed portion 164 of the inner of the two conductors within the pair 138 and the outer edge 172 may be aligned with the exposed portion 164 of the outer of the two conductors 130 of the pair 138.

In an exemplary embodiment, the dielectric frame 120 includes a plurality of frame members 180 extending between the mating end 106 and the terminating end 108, such as between the front 122 and the bottom 128. The frame members 180 hold the conductors 130. The frame members 180 are separated by slots 182. In an exemplary embodiment, the slots 182 are non-continuous and separated by tie bars 184 between the frame members 180. The tie bars 184 are formed during the molding process when the dielectric material is injected into the mold to form the frame members 180. The tie bars 184 hold the relative positions of the frame members 180.

In an exemplary embodiment, each frame member holds a corresponding pair 138 of the conductors 130. The slots 182 provide a space for a shield 186 (FIG. 2). For example, the shield 186 may be coupled to the dielectric frame 120 and extend into the slots 182 to provide electrical shielding between the pairs 138 of conductors 130. The shield 186 may extend along the first side 150 and/or the second side 152. Optionally, two shields 186 may be coupled to the dielectric frame 120 on each of the first and second sides 150, 152 to provide electrical shielding on both sides 150, 152.

In an exemplary embodiment, the insertion loss control windows 160 are provided in the frame members 180, such as approximately centered between corresponding slots 182. Optionally, each frame member 180 may include at least one insertion loss control window 160; however, some of the frame members 180, such as frame members 180 associated with shorter conductors 130, do not include insertion loss control windows 160, such as when there is insufficient space along the frame members 180 to fit the insertion loss control windows 160. Optionally, at least some of the frame members 180 may include multiple insertion loss control windows 160. Optionally, the insertion loss control windows 160 may be separate from the skew windows 156. Alternatively, the insertion loss control windows 160 may be combined with the skew windows 156. For example, the skew window 156 may extend from the insertion loss control window 160 to expose more of the outer of the two conductors 130 of the pair 138, such as a greater width of the outer conductor and/or a greater length of the outer conductor as compared to the inner conductor of the corresponding pair 138.

Figure 6:
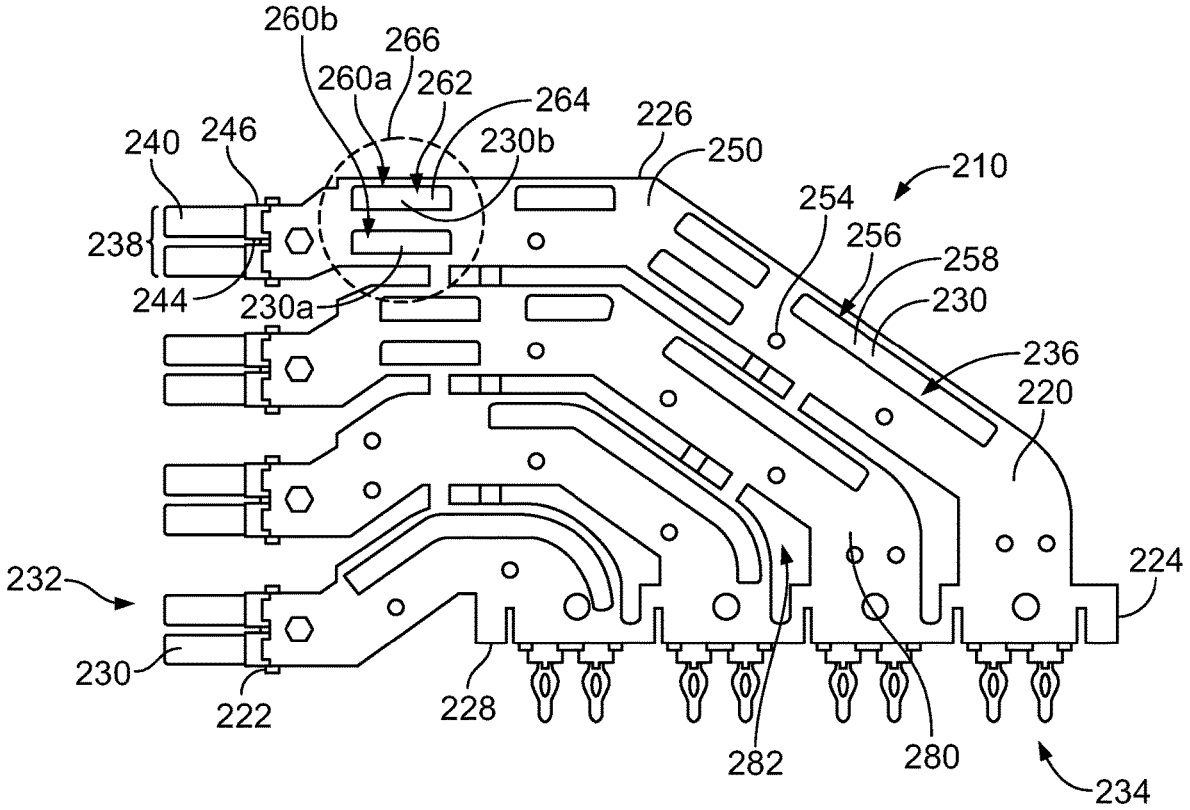
FIG. 6 illustrates a contact module for the electrical connector in accordance with an exemplary embodiment.

FIG. 6 illustrates a contact module 210 for the electrical connector 100 in accordance with an exemplary embodiment. The contact module 210 may be used in place of the contact module 110 (shown in FIG. 3). The contact module 210 includes a plurality of conductors 230 and a dielectric frame 220 holding the conductors 230. In an exemplary embodiment, the conductors 230 are part of a leadframe and the dielectric frame 220 is overmolded over the conductors 230. In an exemplary embodiment, the dielectric frame 220 includes a front 222, a rear 224, a top 226 and a bottom 228.

The conductors 230 each include a mating end 232, a terminating end 234 and a transition portion 236 extending through the dielectric frame 220. In an exemplary embodiment, the conductors 230 are arranged in pairs 238 configured to convey differential signals. In an exemplary embodiment, each conductor 230 has an opposite first side 240 and second side (not shown) extending between first and second edges 244, 246.

The dielectric frame 220 has an opposite first side 250 and second side (not shown). In an exemplary embodiment, the dielectric frame 220 includes a plurality of frame members 280 extending between the mating end 106 and the terminating end 108, such as between the front 222 and the bottom 228. The frame members 280 hold the conductors 230. The frame members 280 are separated by slots 282.

In an exemplary embodiment, the dielectric frame 220 includes a number of openings in the frame members 280 exposing the conductors 230. For example, in an exemplary embodiment, the dielectric frame 220 includes a plurality of pinch points 254, a plurality of skew windows 256 defining exposed portions 258 and insertion loss control windows 260. The insertion loss control windows 260 control insertion loss along the conductors 230. The insertion loss control windows 260 define air pockets 262 exposing exposed portions 264 of the transition portions 236 to air. Providing air around the exposed portions 264 of the transition portions 236 reduces insertion loss and enhances signal integrity of the conductors 230. The size and shape of the insertion loss control windows 260 control insertion losses along the conductors 230.

In an exemplary embodiment, the insertion loss control windows 260 are arranged in pairs 266 along corresponding pairs 238 of the conductors 230. For example, outer insertion loss control windows 260*a* extend along the outer conductor 230*a* of the pair 238 and inner insertion loss control windows 260*b* extend along the inner conductor 230*b* of the pair 238. In an exemplary embodiment, the insertion loss control windows 260*a*, 260*b* in the corresponding pair of windows have identical sizes and shapes to expose both exposed portions 264 to the same amount of air. In an exemplary embodiment, the insertion loss control windows 260*a*, 260*b* in the corresponding pair of windows are aligned along the lengths of the conductors 230. In various embodiments, at least some of the frame members 280 only include insertion loss control windows 260*a*, 260*b* and do not include other windows or pinch points between them on such frame member 280. In an exemplary embodiment, the skew windows 256 are different than the insertion loss control windows 260*a*, 260*b* as the skew windows 256 define air pockets exposing the exposed portions 258 of only the longer or outer conductors 230*a* of the corresponding pair 238 to air for skew control along the conductors 230. In contrast, the insertion loss control windows 260*a*, 260*b* are provided in pairs where both conductors 230*a*, 230*b* are exposed to air by the insertion loss control windows 260*a*, 260*b*.

Figure 7:
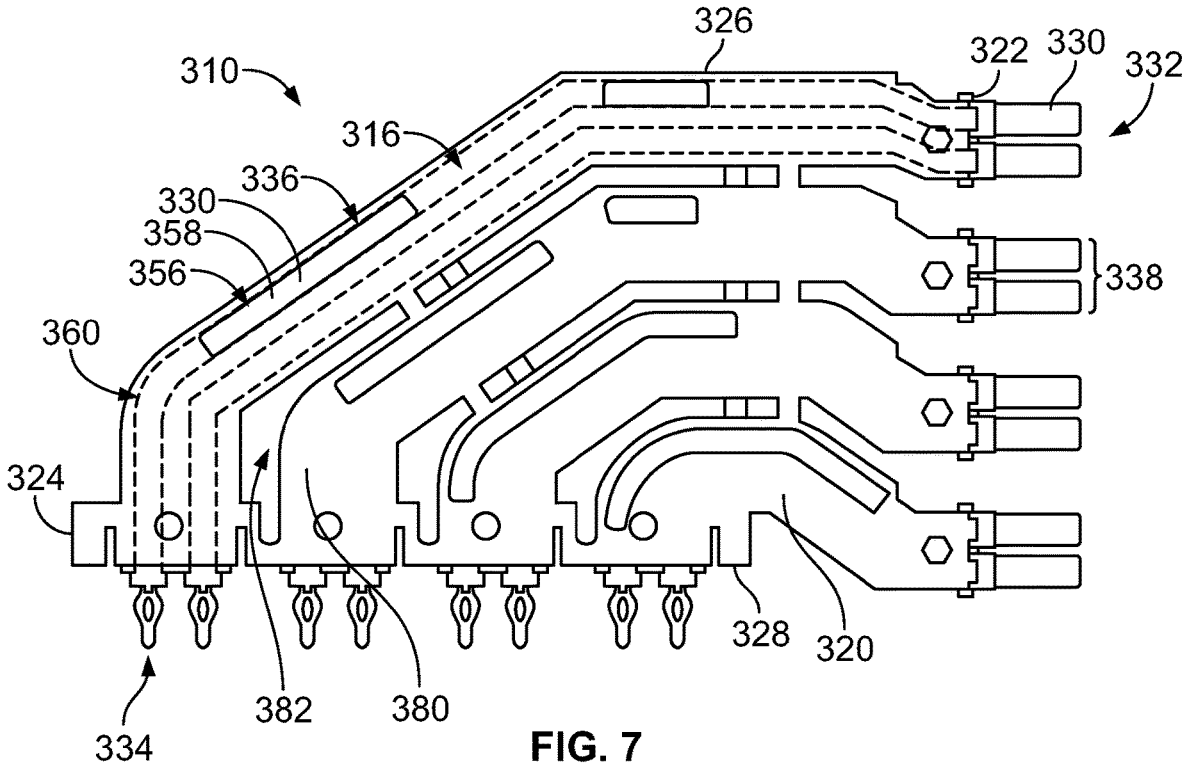
FIG. 7 is a side view of a contact module for the electrical connector in accordance with an exemplary embodiment.
Figure 8:
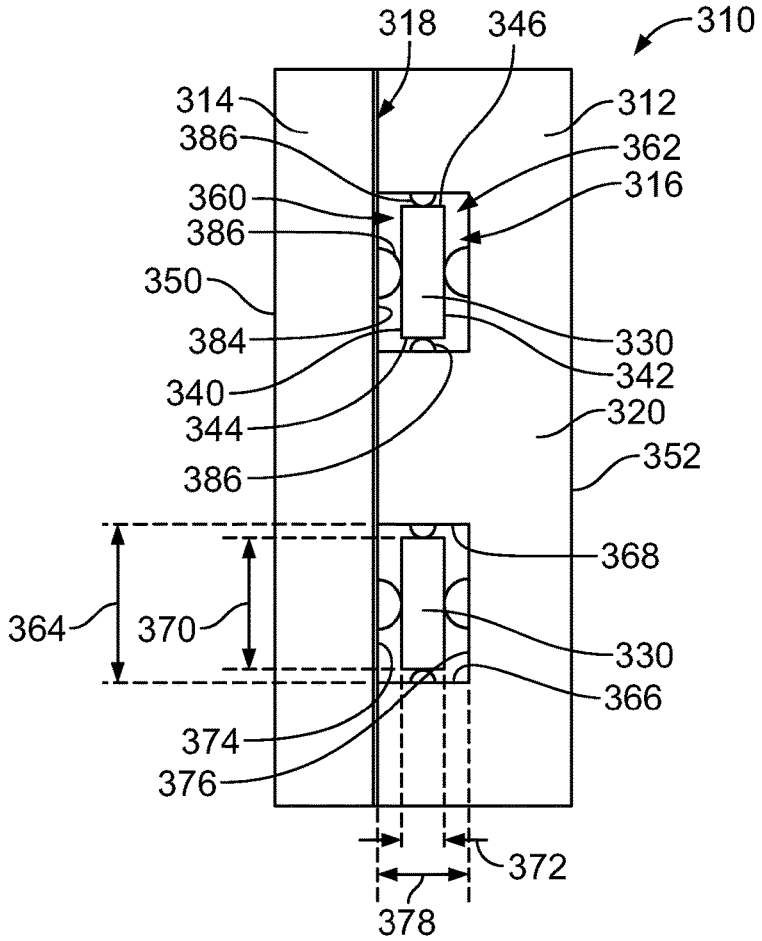
FIG. 8 is a cross-sectional view of a portion of the contact module in accordance with an exemplary embodiment.

FIG. 7 is a side view of a contact module 310 for the electrical connector 100 in accordance with an exemplary embodiment. FIG. 8 is a cross-sectional view of a portion of the contact module 310 in accordance with an exemplary embodiment. The contact module 310 may be used in place of the contact module 110 (shown in FIG. 2). The contact module 310 includes a plurality of conductors 330 (shown in phantom in FIG. 7) and a dielectric frame 320 holding the conductors 330. In an exemplary embodiment, the conductors 330 are stamped and formed conductors. The dielectric frame 320 is a molded frame holding the conductors 330.

In an exemplary embodiment, the dielectric frame 320 is pre-molded and the conductors 330 are inserted or loaded into the dielectric frame 320. Optionally, the dielectric frame 320 is a multi-piece frame having a first frame 312 and a second frame 314 coupled to the first frame 312 after the conductors 330 are loaded into the first frame 312. The first frame 312 includes pockets 316 receiving the conductors 330. Optionally, the second frame 312 may form pockets or portions of the pockets. The first and second frame 312, 314 meet at a seam 318.

In an exemplary embodiment, the dielectric frame 320 includes a front 322, a rear 324, a top 326 and a bottom 328. The dielectric frame 320 has opposite first and second sides 350, 352. In an exemplary embodiment, the dielectric frame 320 includes a plurality of frame members 380 extending between the mating end 106 and the terminating end 108, such as between the front 322 and the bottom 328. The frame members 380 hold the conductors 330. The frame members 380 are separated by slots 382.

The conductors 330 each include a mating end 332, a terminating end 334 and a transition portion 336 extending through the dielectric frame 320. The transition portions 336 are received in the pockets 316. In an exemplary embodiment, the conductors 330 are arranged in pairs 338 configured to convey differential signals. In an exemplary embodiment, each conductor 330 has first and second sides 340, 342 extending between first and second edges 344, 346.

In an exemplary embodiment, the dielectric frame 320 includes a number of openings in the frame members 380 exposing the conductors 330. For example, in an exemplary embodiment, the dielectric frame 320 includes a plurality of skew windows 356 defining exposed portions 358. The skew windows 356 are open at the first and second sides 350, 352. The skew windows 356 are open to the pockets 316.

The dielectric frame 320 includes insertion loss control windows 360. In an exemplary embodiment, the insertion loss control windows 360 are defined by the pockets 316. The insertion loss control windows 360 control insertion loss along the conductors 330. The insertion loss control windows 360 define air pockets 362 exposing exposed portions of the transition portions 336 to air. Providing air around the transition portions 336 reduces insertion loss and enhances signal integrity of the conductors 330. The size and shape of the insertion loss control windows 360 control insertion losses along the conductors 330. In an exemplary embodiment, the insertion loss control windows 360 are internal to the dielectric frame 320 such that the air pockets 362 are enclosed by the dielectric frame 320. However, portions of the insertion loss control windows 360 may be open to the exterior environment. For example, portions of the insertion loss control windows 360 may extend to the first side 350 or the second side 352.

The insertion loss control window 360 entirely surrounds the corresponding exposed portion of the transition portion 336. The insertion loss control window 360 exposes to air the first and second sides 340, 342 and the first and second edges 344, 346 of the corresponding conductor 330 in the same air pocket 362. The pocket 316 is oversized relative to the conductor 330 to form the air pocket 362 around the conductor 330. For example, a height 364 of the pocket 362 between an inner edge wall 366 and an outer edge wall 368 is greater than a height 370 of the conductor 330 between the edges 344, 346 and a width 372 of the pocket 362 between a first side wall 374 and a second side wall 376 is greater than a width 378 of the conductor 330 between the sides 340, 342. The inner edge wall 366 is spaced apart from the first edge 344 of the corresponding conductor 330 and the outer edge wall 368 is spaced apart from the second edge 346 of the corresponding conductor 330. The first side wall 374 is spaced apart from the first side 340 of the corresponding conductor 330 and the second side wall 376 is spaced apart from the second side 342 of the corresponding conductor 330. The inner edge wall 366, the outer edge wall 368, the first side wall 374 and the second side wall 376 define pocket walls 384 defining the pocket 316. The pocket 316 may include other walls to form a pocket having another shape in alternative embodiments.

In an exemplary embodiment, the dielectric frame 320 includes locating tabs 386 extending into the air pockets 362 to engage the conductors 330 and locate the conductors 330 in the insertion loss control windows 360. The locating tabs 386 extend from the inner edge wall 366, the outer edge wall 368, the first side wall 374 and the second side wall 376 to engage the conductor 330. The locating tabs 386 engage the first edge 344, the second edge 346, the first side 340 and the second side 342. The locating tabs 386 hold the inner edge wall 366 apart from the first edge 344 and the outer edge wall 368 apart from the second edge 346. The locating tabs 386 hold the first side wall 374 apart from the first side 340 and the second side wall 376 apart from the second side 342.

Figure 9:
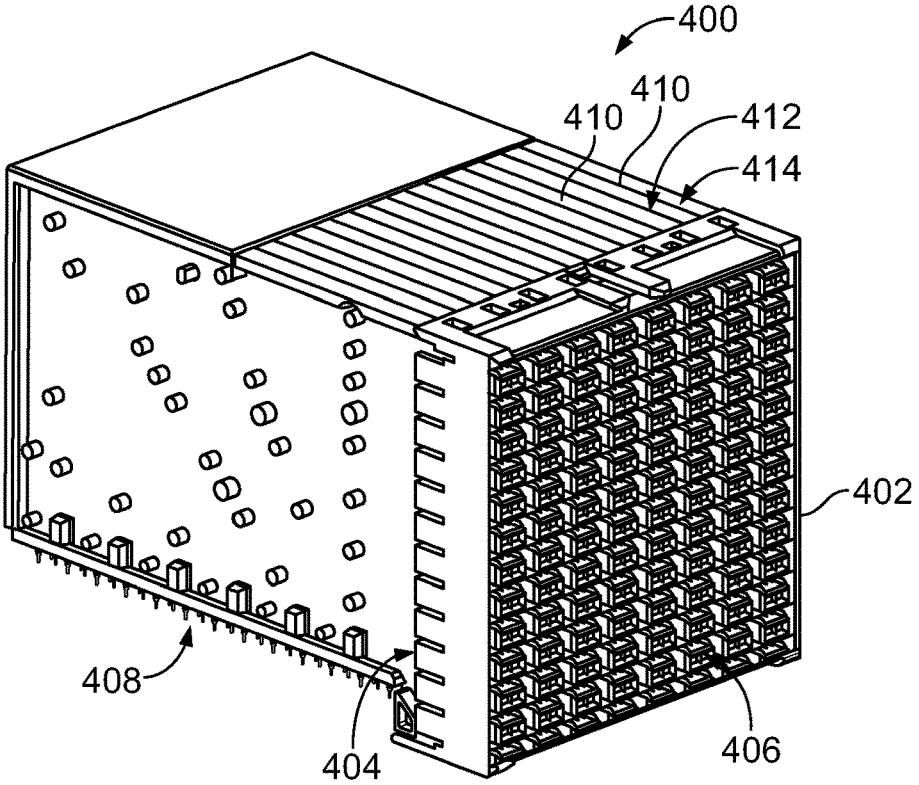
FIG. 9 is a perspective view of an electrical connector in accordance with an exemplary embodiment.
Figure 10:
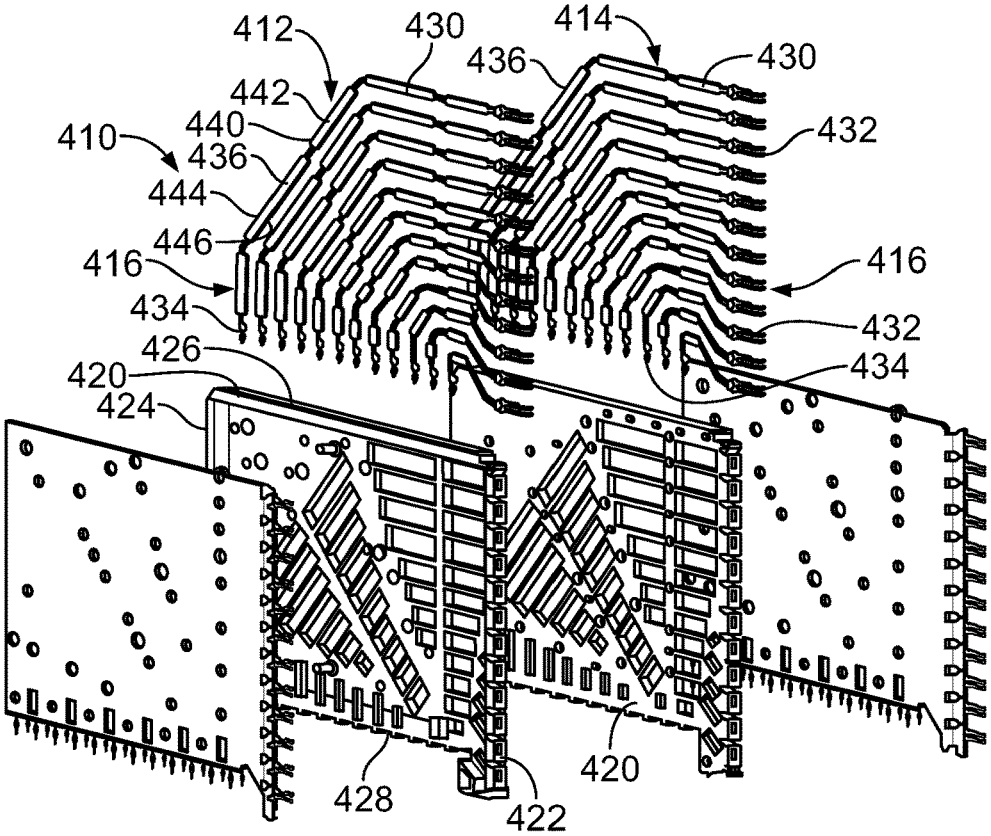
FIG. 10 is an exploded view of a contact module of the electrical connector shown in FIG. 9 in accordance with an exemplary embodiment.

FIG. 9 is a perspective view of an electrical connector 400 formed in accordance with an exemplary embodiment. FIG. 10 is an exploded view of a contact module 410 of the electrical connector 400 in accordance with an exemplary embodiment.

The electrical connector 400 includes a housing 402 holding a plurality of the contact modules 410 in a stacked configuration. In an exemplary embodiment, the housing 402 includes a cavity 404 that receives the contact modules 410. The electrical connector 400 extends between a mating end 406 and a terminating end 408. In an exemplary embodiment, the electrical connector 400 is a right-angle connector having the mating end 406 perpendicular to the terminating end 408. Optionally, the electrical connector 400 may be configured to be mounted to a circuit board at the terminating end 408.

The contact modules 410 each include a plurality of conductors 430 extending between the mating end 406 and the terminating end 408. The conductors 430 are configured to be electrically connected to the circuit board (or the cables in the cable electrical connector). The conductors 430 are configured to be electrically connected to a mating electrical connector, such as a header connector, at the mating end 406. In an exemplary embodiment, the conductors 430 are arranged as differential pairs. The conductors 430 within the pairs are arranged in rows defining pair-in-row contact modules.

Each contact module 410 includes first and second frame assemblies 412, 414. Each frame assembly 412, 414 includes a leadframe 416 and a dielectric frame 420. The frame assemblies 412, 414 are arranged side-by-side to form the contact module 410. The leadframes 416 define the conductors 430. The leadframes 416 are stamped and formed structures. The dielectric frames 420 surround and support the conductors 430 of the leadframes 416. For example, the dielectric frames 420 may be overmolded bodies configured to be overmolded around the leadframes 416. Other manufacturing processes may be utilized. In an exemplary embodiment, the conductors 430 of the first frame assembly 412 are arranged side-by-side with the conductors 430 of the second frame assembly 414 to form differential pairs of signal contacts. The pairs are arranged in rows. The dielectric frames 420 are positioned relative to the leadframes 416 for enhanced electrical performance at high data speeds, such as to achieve target impedance.

In an exemplary embodiment, the dielectric frame 420 includes a front 422, a rear 424, a top 426 and a bottom 428. In the illustrated embodiment, the front 422 is configured to be loaded into the cavity 404 of the housing 402 at the mating end 406. In the illustrated embodiment, the bottom 428 defines the terminating end 408 of the electrical connector 400.

The conductors 430 are signal contacts extending between the mating end 406 and the terminating end 408 for electrically connecting the electrical connector 400 to the mating connector and the circuit board. Optionally, some of the conductors 430 may be ground contacts arranged between various signal contacts to provide electrical shielding for the signal contacts. Alternatively, as in the illustrated embodiment, all of the conductors 430 are signal contacts. The contact modules 410 include shields for providing electrical shielding.

The conductors 430 each include a mating end 432, a terminating end 434 and a transition portion 436 (FIG. 10) extending between the mating end 432 and the terminating end 434. The transition portion 436 extends through the dielectric frame 420 and may be at least partially embedded in the dielectric frame 420.

In an exemplary embodiment, each conductor 430 has a first side 440, a second side 442, an inner or first edge 444 and an outer or second edge 446. Optionally, the first and second edges 444, 446 may be the cut edges formed during the stamping process. For example, the first and second edges 444, 446 extend through the thickness of the metal plate used in the stamping process. Optionally, the first and second sides 440, 442 are wider than the first and second edges 444, 446.

Figure 11:
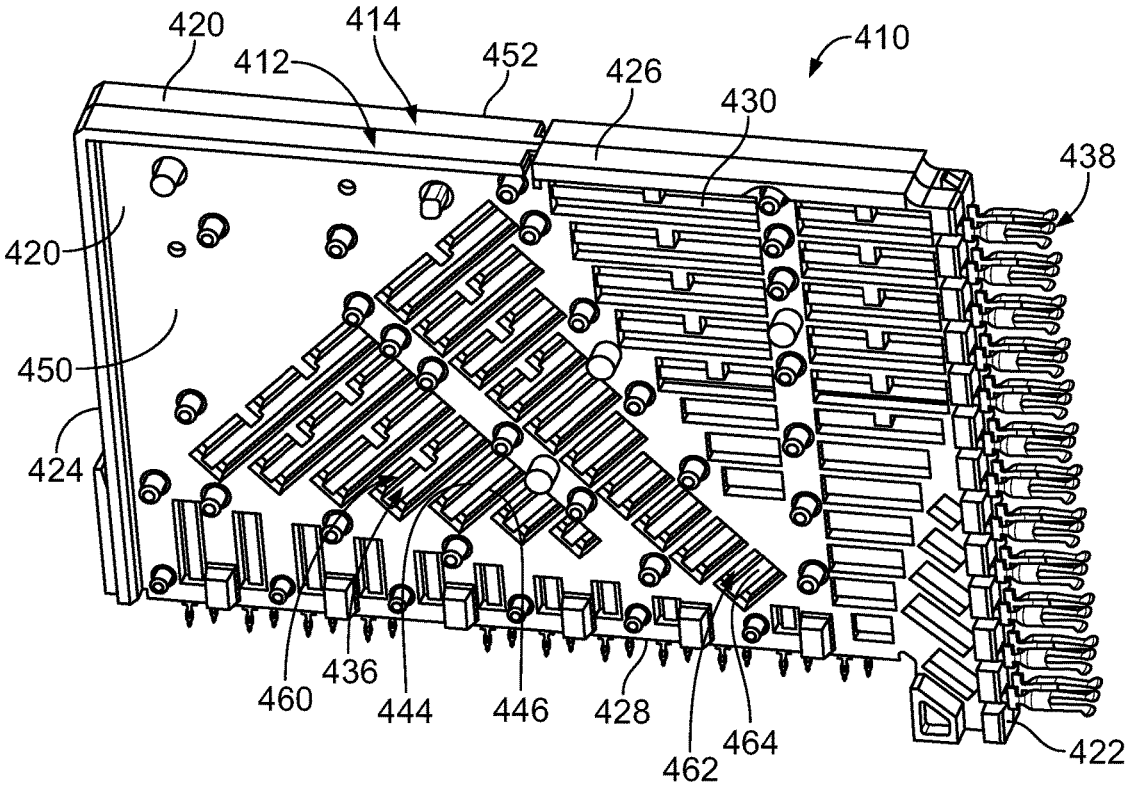
FIG. 11 illustrates a first side of the contact module of the electrical connector shown in FIG. 9 in accordance with an exemplary embodiment.
Figure 12:
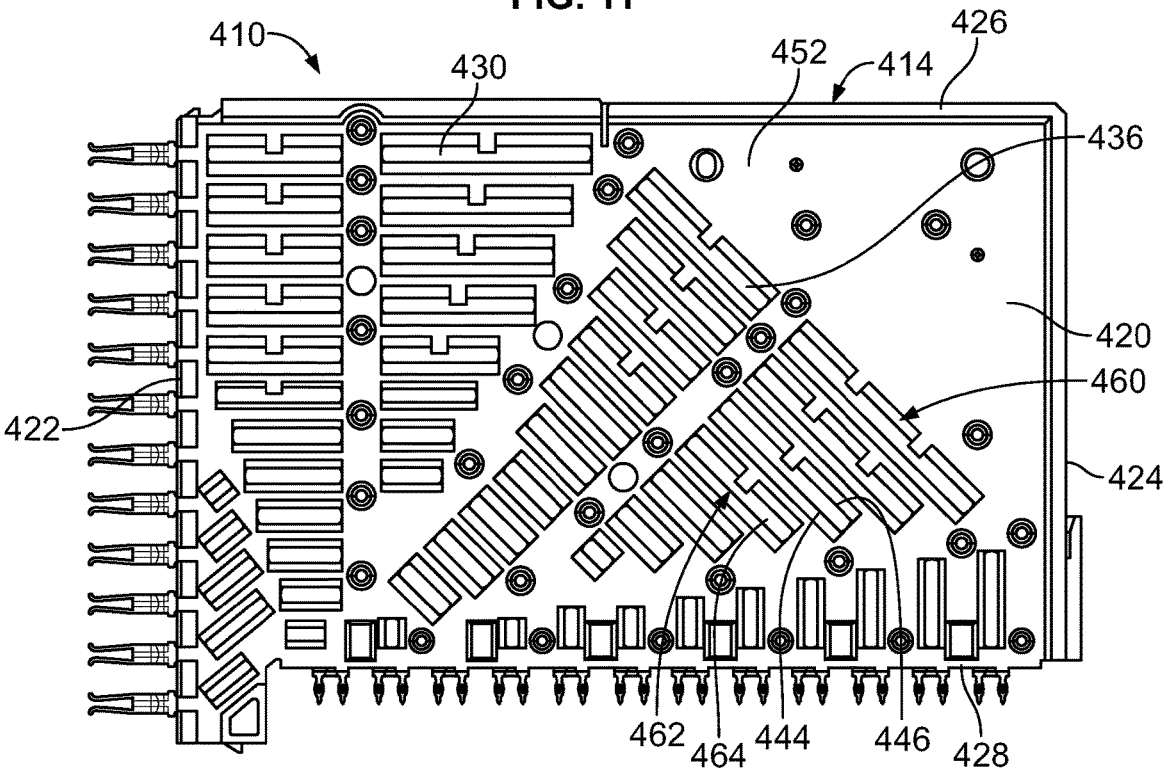
FIG. 12 illustrates a second side of the contact module shown in FIG. 10 in accordance with an exemplary embodiment.
Figure 13:
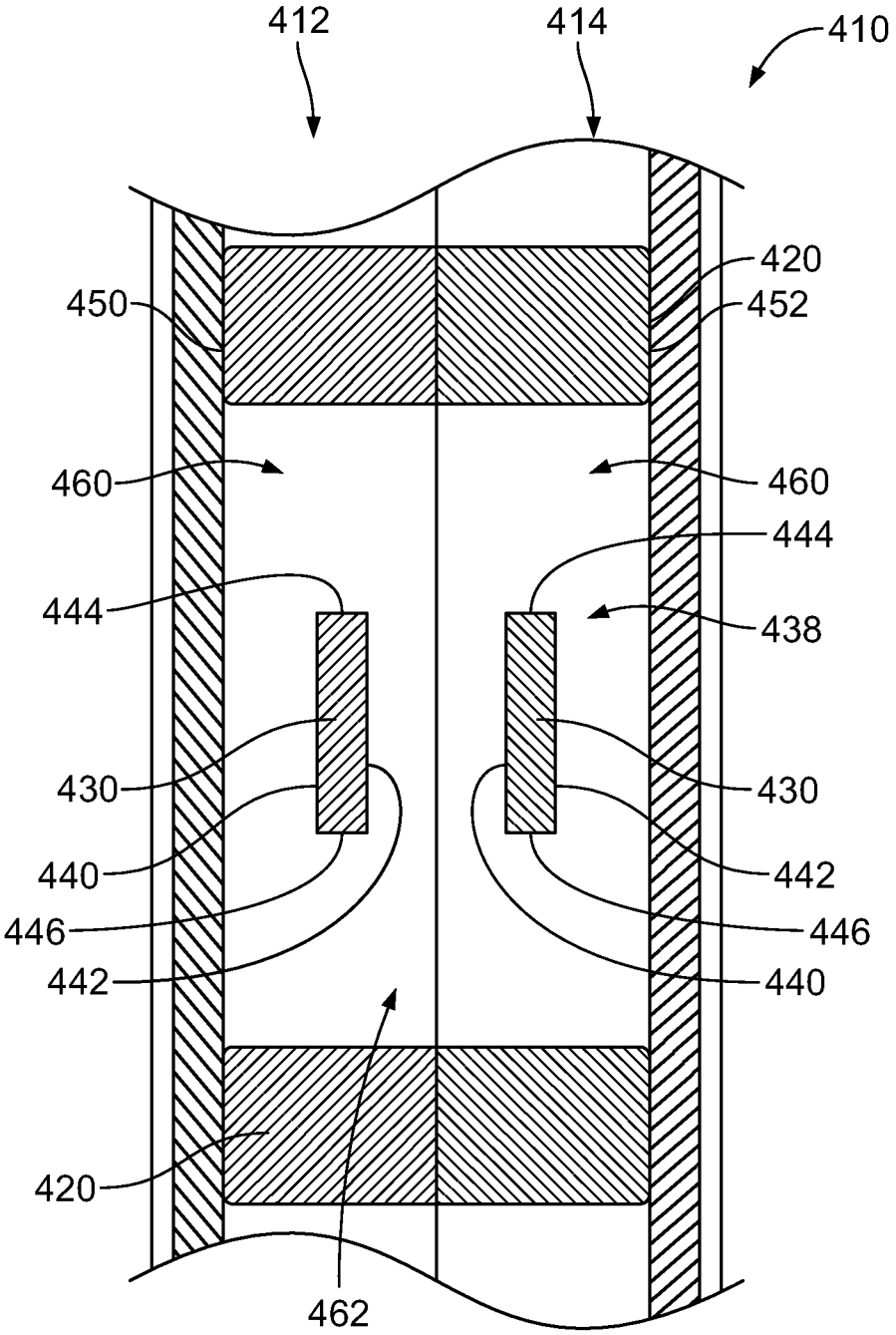
FIG. 13 is a cross sectional view of a portion of the contact module shown in FIG. 10 in accordance with an exemplary embodiment.

FIG. 11 illustrates a first side of the contact module 410 of the electrical connector 400 in accordance with an exemplary embodiment. FIG. 12 illustrates a second side of the contact module 410 in accordance with an exemplary embodiment. FIG. 13 is a cross sectional view of a portion of the contact module 410.

The contact module 410 has opposite first and second sides 450, 452 extending between the front 422 and the rear 424 and extending between the top 426 and the bottom 428. The sides 450, 452 are defined by outer sides of the first and second dielectric frames 420 and are configured to face other contact modules 410 in the contact module stack. Interior sides of the first and second dielectric frames 420 face each other.

In an exemplary embodiment, the dielectric frame 420 includes a number of openings in the first side 450 (FIG. 11) and/or the second side 452 (FIG. 12) exposing the conductors 430. In an exemplary embodiment, the first and second dielectric frames 420 include insertion loss control windows 460 (FIG. 11) in the first side 450 and insertion loss control windows 460 (FIG. 12) in the second side 452. The insertion loss control windows 460 control insertion loss along the conductors 430 of the first and second frame assemblies 412, 414. The insertion loss control windows 460 define air pockets 462 exposing exposed portions 464 of the transition portions 436 to air. Providing air around the exposed portions 464 of the transition portions 436 reduces insertion loss and enhances signal integrity of the conductors 430. The size and shape of the insertion loss control windows 460 control insertion losses along the conductors 430.

In an exemplary embodiment, as shown in FIG. 13, the insertion loss control windows 460 in the first and second dielectric frames 420 are aligned with each other and define a common window or common air pocket exposing both of the conductors 430 within the pairs 438. In various embodiments, the insertion loss control windows 460 expose the first and second sides 440, 442 and the first and second edges 444, 446 of both conductors 430 of the pair 438 in the same insertion loss control window 460. In various embodiments, the entire width of the conductors 430 of each pair 438 are exposed within the insertion loss control window 460.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a contact module having a first dielectric frame holding first conductors and a second dielectric frame holding second conductors stacked with the first dielectric frame to form the contact module;

the first conductors extend between a mating end and a terminating end, the first conductors have a transition portion between the corresponding mating end and the terminating end passing through the first dielectric frame, the transition portions of the first conductors have opposite first and second sides and opposite first and second edges between the first and second sides;

the second conductors extend between a mating end and a terminating end, the second conductors have a transition portion between the corresponding mating end and the terminating end passing through the second dielectric frame, the transition portions of the second conductors have opposite first and second sides and opposite first and second edges between the first and second sides, wherein the first and second conductors are arranged in pairs;

the first dielectric frame having insertion loss control windows defining air pockets exposing exposed portions of the corresponding first conductors to air, the size and shape of the insertion loss control windows controlling insertion loss along the first conductors;

the second dielectric frame having insertion loss control windows defining air pockets exposing exposed portions of the corresponding second conductors to air, the size and shape of the insertion loss control windows controlling insertion loss along the second conductors, wherein the insertion loss control windows of the second dielectric frame are aligned with and open to the insertion loss control windows of the first dielectric frame.

2. The electrical connector of claim 1, wherein the insertion loss control windows expose both the first and second conductors of the corresponding pair in the common air pocket.

3. The electrical connector of claim 1, wherein the insertion loss control windows entirely surrounds the exposed portions of the first and second conductors such that the first and second sides and the first and second edges of both the first and second conductors within the pair are exposed in the common air pocket.

4. The electrical connector of claim 1, wherein the insertion loss control windows in the first and second dielectric frames have identical sizes and shapes.

5. The electrical connector of claim 1, further comprising shields coupled to the first and second dielectric frames to provide electrical shielding for the first and second conductors, the first and second shields covering the insertion loss control windows.

6. A contact module for an electrical connector comprising:

a first dielectric frame holding first conductors, the first conductors each extend between a mating end and a terminating end, the first conductors each have a transition portion between the corresponding mating end and the terminating end passing through the first dielectric frame, the transition portions of the first conductors have opposite first and second sides and opposite first and second edges between the first and second sides, the first dielectric frame having first insertion loss control windows defining air pockets exposing exposed portions of the corresponding first conductors to air, the size and shape of the first insertion loss control windows controlling insertion loss along the first conductors;

a second dielectric frame holding second conductors, the second dielectric frame being stacked with and coupled to the first dielectric frame to form the contact module, the second conductors each extend between a mating end and a terminating end, the second conductors each have a transition portion between the corresponding mating end and the terminating end passing through the second dielectric frame, the transition portions of the second conductors have opposite first and second sides and opposite first and second edges between the first and second sides, wherein the first and second conductors are arranged in pairs, the second dielectric frame having second insertion loss control windows defining air pockets exposing exposed portions of the corresponding second conductors to air, the size and shape of the second insertion loss control windows controlling insertion loss along the second conductors;

wherein the first and second insertion loss control windows are arranged in pairs being aligned with and open to each other to form common air pocket for the pairs of first and second conductors.

7. The contact module of claim 6, wherein the first and second insertion loss control windows expose both the first and second conductors of the corresponding pair in the common air pocket.

8. The contact module of claim 6, wherein the first and second insertion loss control windows entirely surrounds the exposed portions of the first and second conductors of the corresponding pair such that the first and second sides and the first and second edges of both the first and second conductors within the pair are exposed in the common air pocket.

9. The contact module of claim 6, wherein the first dielectric frame includes an interior side and an exterior side, the first insertion loss control windows are open between the interior side and the exterior side, the second dielectric frame includes an interior side and an exterior side, the second insertion loss control windows are open between the interior side and the exterior side, the interior sides of the first and second dielectric frames face each other.

10. The contact module of claim 6, wherein the aligned first and second insertion loss control windows have identical sizes and shapes.

11. The contact module of claim 6, further comprising a first shield coupled to the first dielectric frame and a second shield coupled to the second dielectric frame to provide electrical shielding for the first and second conductors, the first and second shields covering the first and second insertion loss control windows.

* * * * *